US007488393B2

(12) United States Patent
Nakamura et al.

(10) Patent No.: US 7,488,393 B2
(45) **Date of Patent: *Feb. 10, 2009**

(54) RARE EARTH PERMANENT MAGNET

(75) Inventors: Hajime Nakamura, Echizen (JP); Koichi Hirota, Echizen (JP); Masanobu Shimao, Echizen (JP); Takehisa Minowa, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/340,498

(22) Filed: Jan. 27, 2006

(65) Prior Publication Data

US 2006/0213583 A1 Sep. 28, 2006

(30) Foreign Application Priority Data

Mar. 23, 2005 (JP) ..... 2005-084087

(51) Int. Cl.
*H01F 1/057* (2006.01)
*H01F 1/058* (2006.01)

(52) U.S. Cl. ..... 148/302; 148/301; 75/232; 75/236; 75/244

(58) Field of Classification Search ..... None
See application file for complete search history.

(56) References Cited

U.S. PATENT DOCUMENTS 5,194,099 A * 3/1993 Esper et al. ..... 148/302
5,411,603 A * 5/1995 Vial et al. ..... 148/101
5,766,372 A * 6/1998 Fujimura et al. ..... 148/101
5,858,124 A * 1/1999 Endo et al. ..... 148/302
6,296,720 B1 * 10/2001 Yamamoto et al. ..... 148/302
6,302,939 B1 * 10/2001 Rabin et al. ..... 75/338
6,960,240 B2 * 11/2005 Hirota et al. ..... 75/610
7,053,745 B2 * 5/2006 Yoshimura et al. ..... 335/302
2004/0187970 A1 * 9/2004 Ishizaka et al. ..... 148/302

FOREIGN PATENT DOCUMENTS

EP 1 830 371 A1 9/2007
JP 61-195954 * 8/1986

(Continued)

OTHER PUBLICATIONS

Machine Transaltionof Japanese Patent Document 06-244011.*

(Continued)

*Primary Examiner*—John P Sheehan
(74) *Attorney, Agent, or Firm*—Westerman, Hattori, Daniels & Adrian, LLP.

(57) ABSTRACT

A rare earth permanent magnet is in the form of a sintered magnet body having a composition $R^1_aR^2_bT_cA_dF_eO_fM_g$ wherein F and $R^2$ are distributed such that their concentration increases on the average from the center toward the surface of the magnet body, the concentration of $R^2/(R^1+R^2)$ contained in grain boundaries surrounding primary phase grains of $(R^1, R^2)_2T_{14}A$ tetragonal system within the sintered magnet body is on the average higher than the concentration of $R^2/(R^1+R^2)$ contained in the primary phase grains, and the oxyfluoride of $(R^1,R^2)$ is present at grain boundaries in a grain boundary region that extends from the magnet body surface to a depth of at least 20 μm. The invention provides R—Fe—B sintered magnets which exhibit high magnet performance despite minimal amounts of Tb and Dy used.

5 Claims, 2 Drawing Sheets

FOREIGN PATENT DOCUMENTS

| | | | | |
|---|---|---|---|---|
| JP | 1-251704 | | * | 10/1989 |
| JP | 3-188241 | | * | 8/1991 |
| JP | 4-184901 | | * | 7/1992 |
| JP | 4-328804 | | | 11/1992 |
| JP | 5-31807 | | | 5/1993 |
| JP | 6-244011 | A1 | | 9/1994 |
| JP | 3143156 | | | 3/2001 |
| JP | 3471876 | | | 9/2003 |
| JP | 2003-282312 | | | 10/2003 |
| JP | 2004-304038 | | | 10/2004 |
| JP | 2005-11973 | | | 1/2005 |
| WO | 2004/114333 | A1 | | 12/2004 |
| WO | 2005/123974 | A1 | * | 12/2005 |

OTHER PUBLICATIONS

The Journal of the Institute of Electrical Engineers of Japan, vol. 124, 2004, pp. 699-702, published on Nov. 1, 2004.

Press Release (Shin-Etsu News) dated on Mar. 24, 2005.

Intermag Asia 2005; Digest of the IEEE International Magnetics Conference; p. 476; held on Apr. 4-8, 2005.

Techno-Frontier Symposium 2005; pp. B1-2-1 to B1-2-12; held on Apr. 20, 2005 by JMA.

IEEE Transactions on Magnetics, vol. 41, No. 10. Oct. 2005, pp. 3844-3846.

Hwang D. H. et al. "Development of High Coercive Powder From the Nd-Fe-B Sintered Magnet Scrap" IEEE Transactions on Magnetics, IEEE Service Center, New York, NY, US, vol. 40, No. 4, Jul. 2004, pp. 2877-2879.

Extended European Search Report dated Jan. 14, 2008 of European Application No. 06250545.8.

K. D. Durst et al.; "The Coercive Field of Sintered and Melt-Spun NdFeB Magnets", Journal of Magnetism and Magnetic Materials, 68 (1987), pp. 63-75.

K. T. Park et al.; "Effect of Metal-Coating and Consecutive Heat Treatment on Coercivity of Thin Nd-Fe-B Sintered Magnets", Proceedings of the Sixteenth International Workshop on Rare-Earth Magnets and Their Applications, Sendai, (2000) pp. 257-264.

International Search Report of PCT/JP2005/005134 dated Jul. 12, 2005. Associated with copending U.S. Appl. No. 10/572,753.

Translation of International Preliminary Report on Patentability mailed May 3, 2007 of International Application No. PCT/JP2005/005134. Associated with copending U.S. Appl. No. 10/572,753.

International Search Report, dated Jun. 28, 2005, International Application No. PCT/JP2005/005134. Associated with copending U.S. Appl. No. 10/572,753.

Copending U.S. Appl. No. 10/572,753, filed on Mar. 21, 2006.

* cited by examiner

RARE EARTH PERMANENT MAGNET

CROSS-REFERENCE TO RELATED APPLICATION

This non-provisional application claims priority under 35 U.S.C. §119(a) on Patent Application No. 2005-084087 filed in Japan on Mar. 23, 2005, the entire contents of which are hereby incorporated by reference.

FIELD OF THE INVENTION

This invention relates to high-performance Nd—Fe—B permanent magnets having reduced amounts of expensive elements Tb and Dy.

BACKGROUND ART

Because of excellent magnetic properties, Nd—Fe—B permanent magnets find an ever increasing range of application. To meet the recent concern about the environmental problem, the range of utilization of magnets has spread to cover household appliances, industrial equipment, electric automobiles and wind power generators. This requires further improvements in performance of Nd—Fe—B magnets.

Typical indices of magnet performance are remanence (residual magnetic flux density) and coercive force. The remanence of Nd—Fe—B sintered magnets can be increased by increasing the volume fraction of $Nd_2Fe_{14}B$ compound and improving the orientation of crystal grains. Heretofore, many improved processes have been proposed. With respect to the increase of coercive force, there have been proposed many approaches including refinement of crystal grains, use of alloy compositions with increased Nd contents, and addition of effective elements. The current most common approach is to use alloy compositions in which Nd is partially replaced by Dy or Tb. By substituting Dy or Tb for some Nd in $Nd_2Fe_{14}B$ compound, the compound is increased in both anisotropic magnetic field and coercive force. On the other hand, the substitution with Dy or Tb results in the compound having reduced saturation magnetic polarization. Therefore, as long as it is intended to increase the coercive force by this approach, a lowering of remanence is inevitable. Additionally, since Tb and Dy are expensive metals, it is desirable to minimize the amount of Tb and Dy used.

In Nd—Fe—B magnets, the magnitude of an external magnetic field, which creates the nuclei of reverse magnetic domains at grain boundaries, provides a coercive force. The nucleation of reverse magnetic domains is largely affected by the structure of grain boundary, and a disorder of crystalline structure adjacent to the boundary or interface induces a disorder of magnetic structure and facilitates formation of reverse magnetic domains. Although it is generally believed that a magnetic structure extending from the grain boundary to a depth of approximately 5 nm contributes to an enhancement of coercive force, it is difficult to produce an effective form of structure for coercive force enhancement.

Japanese Patent No. 3,471,876 discloses a rare earth magnet having improved corrosion resistance, comprising at least one rare earth element R, which is obtained by effecting fluorinating treatment in a fluoride gas atmosphere or an atmosphere containing a fluoride gas, to form an $RF_3$ compound or an $RO_xF_y$ compound (wherein x and y have values satisfying $0<x<1.5$ and $2x+y=3$) or a mixture thereof with R in the constituent phase in a surface layer of the magnet, and further effecting heat treatment at a temperature of 200 to 1,200° C.

JP-A 2003-282312 discloses an R—Fe—(B,C) sintered magnet (wherein R is a rare earth element, at least 50% of R being Nd and/or Pr) having improved magnetizability which is obtained by mixing an alloy powder for R—Fe—(B,C) sintered magnet with a rare earth fluoride powder so that the powder mixture contains 3 to 20% by weight of the rare earth fluoride (the rare earth being preferably Dy and/or Tb), subjecting the powder mixture to orientation in a magnetic field, compaction and sintering, whereby a primary phase is composed mainly of $Nd_2Fe_{14}B$ grains, and a particulate grain boundary phase is formed at grain boundaries of the primary phase or grain boundary triple points, said grain boundary phase containing the rare earth fluoride, the rare earth fluoride being contained in an amount of 3 to 20% by weight of the overall sintered magnet. Specifically, an R—Fe—(B,C) sintered magnet (wherein R is a rare earth element, at least 50% of R being Nd and/or Pr) is provided wherein the magnet comprises a primary phase composed mainly of $Nd_2Fe_{14}B$ grains and a grain boundary phase containing the rare earth fluoride, the primary phase contains Dy and/or Tb, and the primary phase includes a region where the concentration of Dy and/or Tb is lower than the average concentration of Dy and/or Tb in the overall primary phase.

These proposals, however, are still insufficient in producing a sintered magnet having high performance in terms of remanence and coercive force while reducing the amounts of Tb and Dy used.

JP-A 2005-11973 discloses a rare earth-iron-boron base magnet which is obtained by holding a magnet in a vacuum tank, depositing an element M or an alloy containing an element M (M stands for one or more rare earth elements selected from Pr, Dy, Tb, and Ho) which has been vaporized or atomized by physical means on the entirety or part of the magnet surface in the vacuum tank, and effecting pack cementation so that the element M is diffused and penetrated from the surface into the interior of the magnet to at least a depth corresponding to the radius of crystal grains exposed at the outermost surface of the magnet, to form a grain boundary layer having element M enriched. The concentration of element M in the grain boundary layer is higher at a position nearer to the magnet surface. As a result, the magnet has the grain boundary layer in which element M is enriched by diffusion of element M from the magnet surface. A coercive force Hcj and the content of element M in the overall magnet have the relationship:

$$Hcj \leqq 1+0.2\times M$$

wherein Hcj is a coercive force in unit MA/m and M is the content (wt %) of element M in the overall magnet and $0.05 \leqq M \leqq 10$. This method, however, is extremely unproductive and impractical.

DISCLOSURE OF THE INVENTION

An object of the present invention is to provide R—Fe—B permanent magnets (wherein R is at least two selected from rare earth elements inclusive of Sc and Y) which exhibit high performance despite minimal amounts of Tb and Dy used.

Regarding R—Fe—B sintered magnets (wherein R is one or more elements selected from rare earth elements inclusive of Sc and Y), typically Nd—Fe—B sintered magnets, the inventors have found that when a magnet body is heated at a temperature not higher than a sintering temperature, with a powder based on a fluoride of Dy and/or Tb packing the magnet body surface, both Dy and/or Tb and fluorine which have been in the powder are efficiently absorbed by the magnet body, and Dy and/or Tb is enriched only in proximity to interfaces between grains to enhance an anisotropic magnetic field only in proximity to interfaces, for thereby enhancing a coercive force while restraining diminution of remanence. This approach is successful in reducing the amount of Dy and Tb used as well.

Accordingly, the present invention provides a rare earth permanent magnet in the form of a sintered magnet body having an alloy composition $R^1_aR^2_bT_cA_dF_eM_g$ wherein $R^1$ is at least one element selected from rare earth elements inclusive of Sc and Y and exclusive of Tb and Dy, $R^2$ is one or both of Tb and Dy, T is one or both of iron and cobalt, A is one or both of boron and carbon, F is fluorine, O is oxygen, and M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, a through g indicative of atom percents of the corresponding elements in the alloy have values in the range: $10 \leqq a+b \leqq 15$, $3 \leqq d \leqq 15$, $0.01 \leqq e \leqq 4$, $0.04 \leqq f \leqq 4$, $0.01 \leqq g \leqq 11$, the balance being c, the magnet body having a center and a surface. Constituent elements F and $R^2$ are distributed such that their concentration increases on the average from the center toward the surface of the magnet body. Grain boundaries surround primary phase grains of $(R^1,R^2)_2T_{14}A$ tetragonal system within the sintered magnet body. The concentration of $R^2/(R^1+R^2)$ contained in the grain boundaries is on the average higher than the concentration of $R^2/(R^1+R^2)$ contained in the primary phase grains. The oxyfluoride of $(R^1,R^2)$ is present at grain boundaries in a grain boundary region that extends from the magnet body surface to a depth of at least 20 μm.

In a preferred embodiment, the oxyfluoride of $(R^1,R^2)$ at grain boundaries contains Nd and/or Pr, and an atomic ratio of Nd and/or Pr to $(R^1+R^2)$ contained in the oxyfluoride at grain boundaries is higher than an atomic ratio of Nd and/or Pr to $(R^1+R^2)$ contained at grain boundaries excluding the oxyfluoride and the oxide of $R^3$ wherein $R^3$ is at least one element selected from rare earth elements inclusive of Sc and Y.

In preferred embodiments, $R^1$ comprises at least 10 atom % of Nd and/or Pr; T comprises at least 60 atom % of iron; and A comprises at least 80 atom % of boron.

The present invention is successful in providing R—Fe—B sintered magnets which exhibit high magnet performance despite minimal amounts of Tb and Dy used.

DESCRIPTION OF THE PREFERRED EMBODIMENTS

Figure 1:
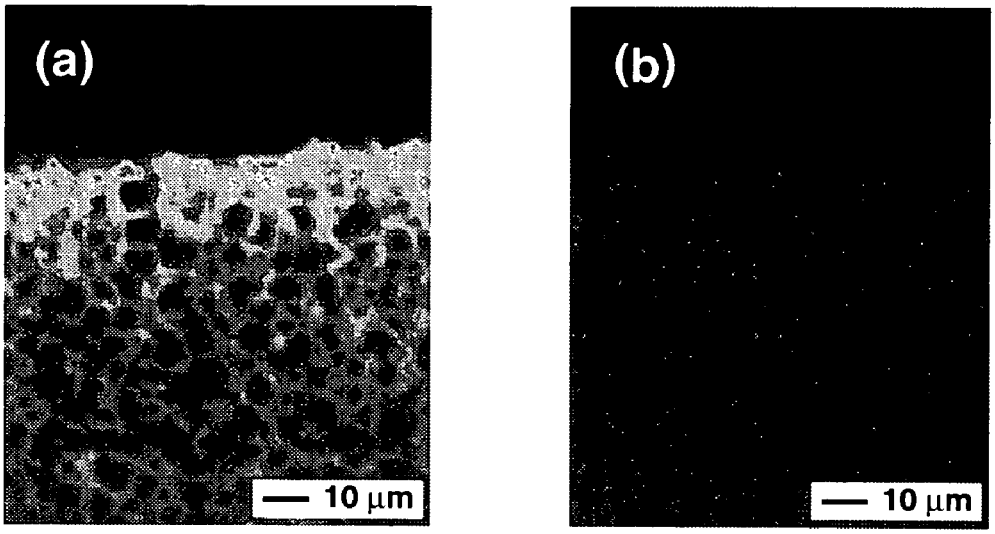
FIGS. 1*a* and 1*b* are photomicrographs showing a Tb distribution image of a magnet body M1 manufactured in Example 1 and a Tb distribution image of a magnet body P1 as machined and heat treated, respectively.

The rare earth permanent magnet of the present invention is in the form of a sintered magnet body having an alloy composition of the formula (1).

$$R^1_aR^2_bT_cA_dF_eO_fM_g \quad (1)$$

Herein $R^1$ is at least one element selected from rare earth elements inclusive of Sc and Y and exclusive of Tb and Dy, $R^2$ is one or both of Tb and Dy, T is one or both of iron (Fe) and cobalt (Co), A is one or both of boron and carbon, F is fluorine, O is oxygen, and M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W. The subscripts a through g indicative of atom percents of the corresponding elements in the alloy have values in the range: $10 \leqq a+b \leqq 15$, $3 \leqq d \leqq 15$, $0.01 \leqq e \leqq 4$, $0.04 \leqq f \leqq 4$, $0.01 \leqq g \leqq 11$, the balance being c.

Specifically, $R^1$ is selected from among Sc, Y, La, Ce, Pr, Nd, Sm, Eu, Gd, Ho, Er, Yb, and Lu. Desirably, $R^1$ contains Nd and/or Pr as a main component, the content of Nd and/or Pr being preferably at least 10 atom %, more preferably at least 50 atom % of $R^1$. $R^2$ is one or both of Tb and Dy.

The total amount (a+b) of $R^1$ and $R^2$ is 10 to 15 atom %, as recited above, and preferably 12 to 15 atom %. The amount (b) of $R^2$ is preferably 0.01 to 8 atom %, more preferably 0.05 to 6 atom %, and even more preferably 0.1 to 5 atom %.

The amount (c) of T, which is Fe and/or Co, is preferably at least 60 atom %, and more preferably at least 70 atom %. Although cobalt can be omitted (i.e., 0 atom %), cobalt may be included in an amount of at least 1 atom %, preferably at least 3 atom %, more preferably at least 5 atom % for improving the temperature stability of remanence or other purposes.

Preferably A, which is boron and/or carbon, contains at least 80 atom %, more preferably at least 85 atom % of boron. The amount (d) of A is 3 to 15 atom %, as recited above, preferably 4 to 12 atom %, and more preferably 5 to 8 atom %.

The amount (e) of fluorine is 0.01 to 4 atom %, as recited above, preferably 0.02 to 3.5 atom %, and more preferably 0.05 to 3.5 atom %. At too low a fluorine content, an enhancement of coercive force is not observable. Too high a fluorine content alters the grain boundary phase, leading to a reduced coercive force.

The amount (f) of oxygen is 0.04 to 4 atom %, as recited above, preferably 0.04 to 3.5 atom %, and more preferably 0.04 to 3 atom %.

The amount (g) of other metal element M is 0.01 to 11 atom %, as recited above, preferably 0.01 to 8 atom %, and more preferably 0.02 to 5 atom %. The other metal element M may be present in an amount of at least 0.05 atom %, and especially at least 0.1 atom %.

It is noted that the sintered magnet body has a center and a surface. In the invention, constituent elements F and $R^2$ are distributed in the sintered magnet body such that their concentration increases on the average from the center of the magnet body toward the surface of the magnet body. Specifically, the concentration of F and $R^2$ is highest at the surface of the magnet body and gradually decreases toward the center of the magnet body. Fluorine may be absent at the magnet body center because the invention merely requires that the oxyfluoride of $R^1$ and $R^2$, typically $(R^1_{1-x}R^2_x)OF$ (wherein x is a number of 0 to 1) be present at grain boundaries in a grain boundary region that extends from the magnet body surface to a depth of at least 20 μm. While grain boundaries surround primary phase grains of $(R^1,R^2)_2T_{14}A$ tetragonal system within the sintered magnet body, the concentration of $R^2/(R^1+R^2)$ contained in the grain boundaries is on the average higher than the concentration of $R^2/(R^1+R^2)$ contained in the primary phase grains.

In a preferred embodiment, the oxyfluoride of $(R^1,R^2)$ present at grain boundaries contains Nd and/or Pr, and an atomic ratio of Nd and/or Pr to $(R^1+R^2)$ contained in the oxyfluoride at grain boundaries is higher than an atomic ratio of Nd and/or Pr to $(R^1+R^2)$ contained at grain boundaries excluding the oxyfluoride and the oxide of $R^3$ wherein $R^3$ is at least one element selected from rare earth elements inclusive of Sc and Y.

The rare earth permanent magnet of the invention can be manufactured by feeding a powder containing the fluoride of Tb and/or Dy to the surface of an R—Fe—B sintered magnet body, and heat treating the packed magnet body. The R—Fe—B sintered magnet body, in turn, can be manufactured by a conventional process including crushing a mother alloy, milling, compacting and sintering.

The mother alloy used herein contains R, T, A, and M. R is at least one element selected from rare earth elements inclusive of Sc and Y. R is typically selected from among Sc, Y, La, Ce, Pr, Nd, Sm, Eu, Gd, Tb, Dy, Ho, Er, Yb, and Lu. Desirably, R contains Nd, Pr and Dy as main components. These rare earth elements inclusive of Sc and Y are preferably present in an amount of 10 to 15 atom %, more preferably 12 to 15 atom % of the overall alloy. More desirably, R contains one or both of Nd and Pr in an amount of at least 10 atom %, especially at least 50 atom % of the entire R. T is one or both of Fe and Co, and Fe is preferably contained in an amount of at least 50 atom %, and more preferably at least 65 atom % of the overall alloy. A is one or both of boron and carbon, and boron is preferably contained in an amount of 2 to 15 atom %, and more preferably 3 to 8 atom % of the overall alloy. M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W. M may be contained in an amount of 0.01 to 11 atom %, and preferably 0.1 to 5 atom % of the overall alloy. The balance is composed of incidental impurities such as N and O.

The mother alloy is prepared by melting metal or alloy feeds in vacuum or an inert gas atmosphere, typically argon atmosphere, and casting the melt into a flat mold or book mold or strip casting. A possible alternative is a so-called two-alloy process involving separately preparing an alloy approximate to the $R_2Fe_{14}B$ compound composition constituting the primary phase of the relevant alloy and an R-rich alloy serving as a liquid phase aid at the sintering temperature, crushing, then weighing and mixing them. Notably, the alloy approximate to the primary phase composition is subjected to homogenizing treatment, if necessary, for the purpose of increasing the amount of the $R_2Fe_{14}B$ compound phase, since $\alpha$-Fe is likely to be left depending on the cooling rate during casting and the alloy composition. The homogenizing treatment is a heat treatment at 700 to 1,200° C. for at least one hour in vacuum or in an Ar atmosphere. To the R-rich alloy serving as a liquid phase aid, a so-called melt quenching or strip casting technique is applicable as well as the above-described casting technique.

The mother alloy is generally crushed to a size of 0.05 to 3 mm, preferably 0.05 to 1.5 mm. The crushing step uses a Brown mill or hydriding pulverization, with the hydriding pulverization being preferred for those alloys as strip cast. The coarse powder is then finely divided to a size of generally 0.2 to 30 μm, preferably 0.5 to 20 μm, for example, by a jet mill using nitrogen under pressure. The oxygen content of the sintered body can be controlled by admixing a minor amount of oxygen with the pressurized nitrogen at this point. The oxygen content of the final sintered body, which is given as the oxygen introduced during the preparation of the ingot plus the oxygen taken up during transition from the fine powder to the sintered body, is preferably 0.04 to 4 atom %, more preferably 0.04 to 3.5 atom %.

The fine powder is then compacted under a magnetic field on a compression molding machine and placed in a sintering furnace. Sintering is effected in vacuum or in an inert gas atmosphere usually at a temperature of 900 to 1,250° C., preferably 1,000 to 1,100° C. The thus sintered magnet contains 60 to 99 vol %, preferably 80 to 98 vol % of the tetragonal $R_2Fe_{14}B$ compound as a primary phase, the balance being 0.5 to 20 vol % of an R-rich phase, 0 to 10 vol % of a B-rich phase, 0.1 to 10 vol % of R oxide, and at least one of carbides, nitrides and hydroxides of incidental impurities or a mixture or composite thereof.

The sintered magnet body (or sintered block) is machined to a predetermined shape, after which a powder containing the fluoride of Tb and/or Dy is disposed on the surface of the magnet body. The magnet body packed with the fluoride powder is heat treated in vacuum or in an atmosphere of inert gas such as Ar or He at a temperature of not higher than the sintering temperature (referred to as Ts), especially 200° C. to (Ts-5)° C. for about 0.5 to 100 hours. Through the heat treatment, the fluoride of Tb and/or Dy is infiltrated in the magnet and the rare earth oxide within the sintered magnet body reacts with fluorine to make a chemical change into an oxyfluoride. The amount of fluorine absorbed in the magnet body at this point varies with the composition and particle size of the powder used, the proportion of the powder occupying the magnet surface-surrounding space during the heat treatment, the specific surface area of the magnet, the temperature and time of the heat treatment although the absorbed fluorine amount is preferably 0.01 to 4 atom %, more preferably 0.05 to 3.5 atom %. At this point, the absorbed Tb and/or Dy component concentrates adjacent to the grain boundaries.

The powder fed to the surface of the sintered magnet body may consist solely of the fluoride of Tb and/or Dy although the magnet of the invention can be manufactured as long as the powder contains at least 15% by weight, especially at least 30% by weight of the fluoride of Tb and/or Dy. Suitable components of the powder other than the fluoride of Tb and/or Dy include fluorides of other rare earth elements such as Nd and Pr, oxides, oxyfluorides, carbides, hydrides, hydroxides, oxycarbides, and nitrides of rare earth elements inclusive of Tb and Dy, fine powders of boron, boron nitride, silicon, carbon or the like, and organic compounds such as stearic acid.

The amount of the powder fed to the surface of the sintered magnet body may be about 0.1 to about 100 mg/cm$^2$, preferably about 0.5 to about 50 mg/cm$^2$ of the surface.

Preferably the magnet body is further subjected to aging treatment.

The oxyfluoride of R (rare earth elements inclusive of Sc and Y) within the magnet is typically ROF, although it generally denotes oxyfluorides containing R, oxygen and fluorine that can achieve the effect of the invention including $RO_mF_n$ (wherein m and n are positive numbers) and modified or stabilized forms of $RO_mF_n$ wherein part of R is replaced by a metal element.

The thus obtained permanent magnet material containing the oxyfluoride of R can be used as a high-performance permanent magnet.

EXAMPLE

Examples of the present invention are given below by way of illustration and not by way of limitation.

Example 1 and Comparative Example 1

An alloy in thin plate form consisting of 11.5 atom % Nd, 2.0 atom % Pr, 0.5 atom % Al, 0.3 atom % Cu, 5.8 atom % B, and the balance of Fe was prepared by using Nd, Pr, Al, Fe, and Cu metals of at least 99 wt % purity and ferroboron, high-frequency melting them in an Ar atmosphere, and casting the melt onto a single chill roll of copper (strip casting technique). The alloy was exposed to hydrogen under 0.11 MPa at room temperature for hydriding, heated up to 500° C. for partial dehydriding while evacuating the chamber to vacuum, cooled down, and sieved, obtaining a coarse powder of under 50 mesh.

On a jet mill using nitrogen gas under pressure, the coarse powder was finely divided into a powder with a mass base median diameter of 4.5 μm. The fine powder was oriented in a magnetic field of 15 kOe under a nitrogen atmosphere and compacted under a pressure of about 1 ton/cm$^2$. The compact was then placed in a sintering furnace with an Ar atmosphere where it was sintered at 1,060° C. for 2 hours, obtaining a magnet block. Using a diamond cutter, the magnet block was machined on all the surfaces to dimensions of 4 mm×4 mm×2 mm thick. The magnet body was successively washed with alkaline solution, deionized water, nitric acid and deionized water, and dried.

Subsequently the magnet body was immersed in a suspension of 50 wt % terbium fluoride in ethanol for 30 seconds while sonicating the suspension. The terbium fluoride powder had an average particle size of 5 μm. The magnet was taken up and placed in a vacuum desiccator where it was dried at room temperature for 30 minutes while evacuating by a rotary pump.

The magnet body packed with terbium fluoride was subjected to heat treatment in an Ar atmosphere at 850° C. for 5 hours and then aging treatment at 500° C. for one hour, and quenched, obtaining a magnet body within the scope of the invention. This magnet body is designated M1. For comparison purposes, a magnet body was prepared by effecting heat treatment without the terbium fluoride package. This is designated P1.

The magnet bodies M1 and P1 were measured for magnetic properties (remanence Br, coercive force Hcj, (BH)max), with the results shown in Table 1. The compositions of the magnets are shown in Table 2. The magnet M1 of the invention marked a coercive force increase of 800 kAm$^{-1}$ relative to the coercive force of the magnet P1 having undergone heat treatment without the terbium fluoride package while showing a remanence decline of 5 mT.

Figure 2:
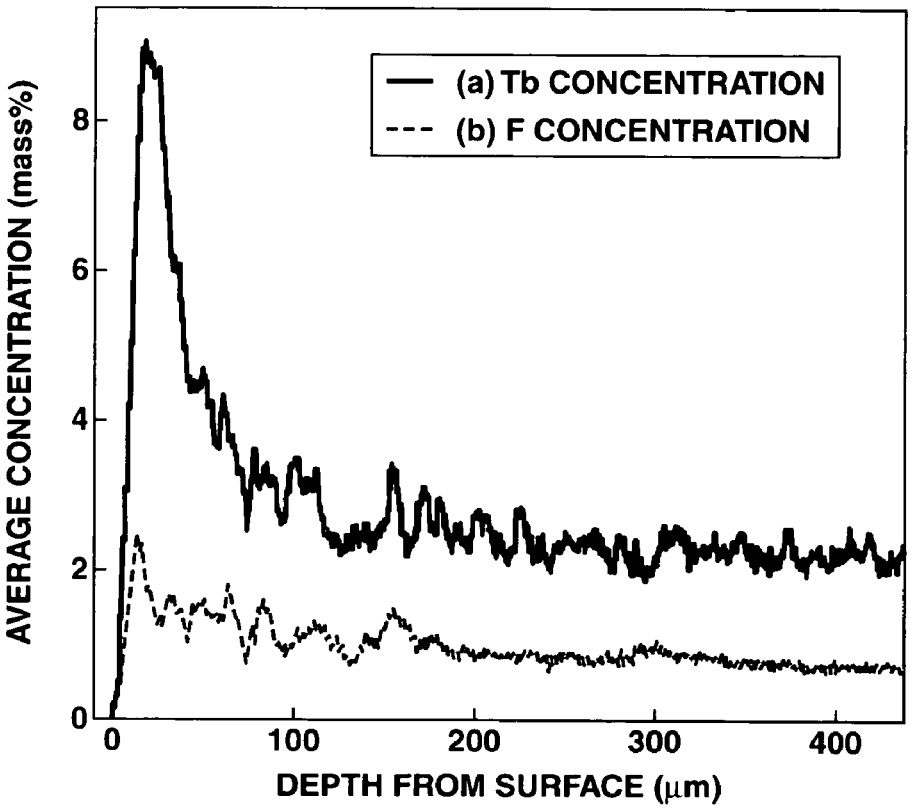
FIG. 2 is a graph in which the average concentrations of Tb (a) and F (b) in the magnet body M1 of Example 1 are plotted relative to a depth from the magnet surface.
Figure 3:
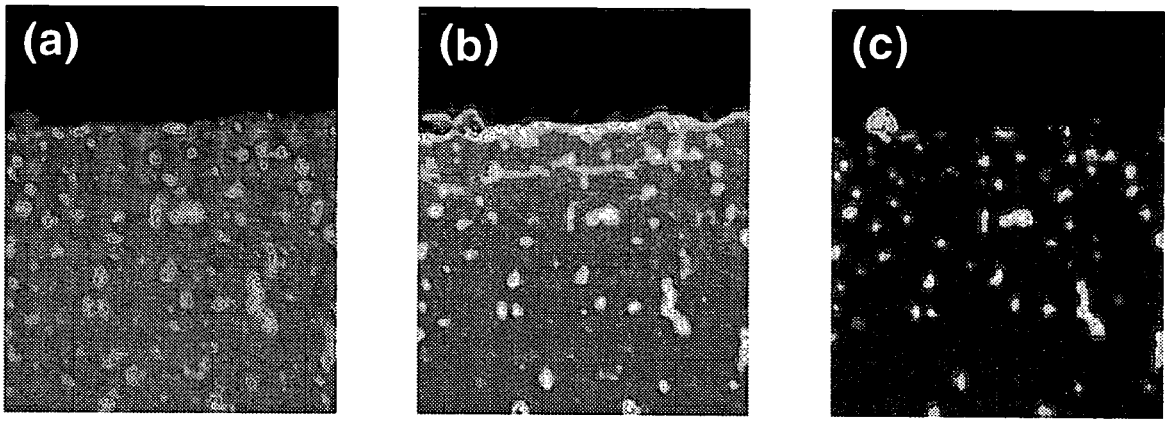
FIGS. 3*a*, 3*b*, and 3*c* are photomicrographs showing compositional distribution images of Nd, O, and F in the magnet body M1 of Example 1, respectively.

The magnet bodies M1 and P1 were analyzed by electron probe microanalysis (EPMA), with their Tb distribution images being shown in FIGS. 1*a* and 1*b*. Since the source alloy for the magnet is free of Tb, bright contrast spots indicative of the presence of Tb are not found in the image of P1. In contrast, the magnet M1 having undergone heat treatment with the terbium fluoride package manifests that Tb is enriched only at grain boundaries. In the graph of FIG. 2, the average concentrations of Tb and F in the magnet M1 are plotted relative to a depth from the magnet body surface. Tb and F having enriched at grain boundaries increase their concentration as the position moves nearer to the magnet body surface. FIG. 3 illustrates distribution images of Nd, O and F under the same field of view as in FIG. 1. It is understood that fluorine once absorbed reacts with neodymium oxide already present within the magnet to form neodymium oxyfluoride. These data prove that a magnet body characterized by the enrichment of Tb at grain boundaries, the dispersion of oxyfluoride, and the graded concentrations of Tb and F exhibits better magnetic properties with a minimal amount of Tb added.

Example 2 and Comparative Example 2

An alloy in thin plate form consisting of 13.5 atom % Nd, 0.5 atom % Al, 5.8 atom % B, and the balance of Fe was prepared by using Nd, Al, and Fe metals of at least 99 wt % purity and ferroboron, high-frequency melting them in an Ar atmosphere, and casting the melt onto a single chill roll of copper (strip casting technique). The alloy was exposed to hydrogen under 0.11 MPa at room temperature for hydriding, heated up to 500° C. for partial dehydriding while evacuating the chamber to vacuum, cooled down, and sieved, obtaining a coarse powder of under 50 mesh.

Separately, an ingot consisting of 20 atom % Nd, 10 atom % Tb, 24 atom % Fe, 6 atom % B, 1 atom % Al, 2 atom % Cu, and the balance of Co was prepared by using Nd, Tb, Fe, Co, Al, and Cu metals of at least 99 wt % purity and ferroboron, high-frequency melting them in an Ar atmosphere, and casting the melt in a flat mold. The ingot was ground in a nitrogen atmosphere on a jaw crusher and a Brown mill in sequence, and sieved, obtaining a coarse powder of under 50 mesh.

The two types of powder were mixed in a weight ratio of 90:10. On a jet mill using nitrogen gas under pressure, the powder mixture was finely divided into a powder with a mass base median diameter of 3.8 μm. The fine powder was oriented in a magnetic field of 15 kOe under a nitrogen atmosphere and compacted under a pressure of about 1 ton/cm$^2$. The compact was then placed in a sintering furnace with an Ar atmosphere where it was sintered at 1,060° C. for 2 hours, obtaining a magnet block. Using a diamond cutter, the magnet block was machined on all the surfaces to dimensions of 4 mm×4 mm×1 mm thick. The magnet body was successively washed with alkaline solution, deionized water, nitric acid and deionized water, and dried.

Subsequently the magnet body was immersed in a suspension of 50 wt % dysprosium fluoride in ethanol for 30 seconds while sonicating the suspension. The dysprosium fluoride powder had an average particle size of 10 am. The magnet was taken up and placed in a vacuum desiccator where it was dried at room temperature for 30 minutes while evacuating by a rotary pump.

The magnet body packed with dysprosium fluoride was subjected to heat treatment in an Ar atmosphere at 800° C. for 10 hours and then aging treatment at 510° C. for one hour, and quenched, obtaining a magnet body within the scope of the invention. This magnet body is designated M2. For comparison purposes, a magnet body was prepared by effecting heat treatment without the dysprosium fluoride package. This is designated P2.

The magnet bodies M2 and P2 were measured for magnetic properties (Br, Hcj, (BH)max), with the results also shown in Table 1. The compositions of the magnets are shown in Table 2. The magnet M2 of the invention marked a coercive force increase of 520 kAm$^{-1}$ relative to the coercive force of the magnet P2 having undergone heat treatment without the dysprosium fluoride package while showing a remanence decline of 5 mT. The distributions of Dy and F in the magnet M2 as analyzed by EPMA were equivalent to the distributions of Tb and F in Example 1.

Example 3 and Comparative Example 3

An alloy in thin plate form consisting of 12.5 atom % Nd, 1.5 atom % Dy, 0.5 atom % Al, 5.8 atom % B, and the balance of Fe was prepared by using Nd, Dy, Al, and Fe metals of at least 99 wt % purity and ferroboron, high-frequency melting them in an Ar atmosphere, and casting the melt onto a single chill roll of copper (strip casting technique). The alloy was exposed to hydrogen under 0.11 MPa at room temperature for hydriding, heated up to 500° C. for partial dehydriding while evacuating the chamber to vacuum, cooled down, and sieved, obtaining a coarse powder of under 50 mesh.

On a jet mill using nitrogen gas under pressure, the coarse powder was finely divided into a powder with a mass base median diameter of 4.0 am. The fine powder was oriented in a magnetic field of 15 kOe under a nitrogen atmosphere and compacted under a pressure of about 1 ton/cm$^2$. The compact was then placed in a sintering furnace with an Ar atmosphere where it was sintered at 1,060° C. for 2 hours, obtaining a magnet block. Using a diamond cutter, the magnet block was machined on all the surfaces to dimensions of 10 mm×10 mm×3 mm thick. The magnet body was successively washed with alkaline solution, deionized water, nitric acid and deionized water, and dried.

Subsequently the magnet body was immersed in a suspension of 50 wt % terbium fluoride in ethanol for 30 seconds while sonicating the suspension. The terbium fluoride powder had an average particle size of 5 μm. The magnet was taken up and immediately dried with hot air blow.

The magnet body packed with terbium fluoride was subjected to heat treatment in an Ar atmosphere at 800° C. for 10 hours and then aging treatment at 585° C. for one hour, and quenched, obtaining a magnet body within the scope of the invention. This magnet body is designated M3. For comparison purposes, a magnet body was prepared by effecting heat treatment without the terbium fluoride package. This is designated P3.

The magnet bodies M3 and P3 were measured for magnetic properties (Br, Hcj, (BH)max), with the results also shown in Table 1. The compositions of the magnets are shown in Table 2. The magnet M3 of the invention marked a coercive force increase of 750 kAm$^{-1}$ relative to the coercive force of the magnet P3 having undergone heat treatment without the terbium fluoride package while showing a remanence decline of 5 mT. The distributions of Tb and F in the magnet M3 as analyzed by EPMA were equivalent to those in Example 1.

Examples 4-8 and Comparative Examples 4-8

An alloy in thin plate form consisting of 11.5 atom % Nd, 2.0 atom % Pr, 0.5 atom % Al, 0.3 atom % Cu, 0.5 atom % M' (=Cr, V, Nb, Ga or W), 5.8 atom % B, and the balance of Fe was prepared by using Nd, Pr, Al, Fe, Cu, Cr, V, Nb, Ga, and W metals of at least 99 wt % purity and ferroboron, high-frequency melting them in an Ar atmosphere, and casting the melt onto a single chill roll of copper (strip casting technique). The alloy was exposed to hydrogen under 0.11 MPa at room temperature for hydriding, heated up to 500° C. for partial dehydriding while evacuating the chamber to vacuum, cooled down, and sieved, obtaining a coarse powder of under 50 mesh.

On a jet mill using nitrogen gas under pressure, the coarse powder was finely divided into a powder with a mass base median diameter of 4.7 μm. The fine powder was oriented in a magnetic field of 15 kOe under a nitrogen atmosphere and compacted under a pressure of about 1 ton/cm$^2$. The compact was then placed in a sintering furnace with an Ar atmosphere where it was sintered at 1,060° C. for 2 hours, obtaining a magnet block. Using a diamond cutter, the magnet block was machined on all the surfaces to dimensions of 5 mm×5 mm×2.5 mm thick. The magnet body was successively washed with alkaline solution, deionized water, citric acid and deionized water, and dried.

Subsequently the magnet body was immersed in a suspension of 50 wt % a 50:50 (weight ratio) dysprosium fluoride/dysprosium oxide mix in ethanol for 30 seconds while sonicating the suspension. The dysprosium fluoride and dysprosium oxide powders had an average particle size of 5 μm and 1 μm, respectively. The magnet was taken up and placed in a vacuum desiccator where it was dried at room temperature for 30 minutes while evacuating by a rotary pump.

The magnet body packed with the dysprosium fluoride/dysprosium oxide mix was subjected to heat treatment in an Ar atmosphere at 800° C. for 8 hours and then aging treatment at 500° C. for one hour, and quenched, obtaining a magnet body within the scope of the invention. These magnet bodies are designated M4 to M8 in the order of M'=Cr, V, Nb, Ga, and W. For comparison purposes, magnet bodies were prepared by effecting heat treatment without the dysprosium package. They are designated P4 to P8.

The magnet bodies M4 to M8 and P4 to P8 were measured for magnetic properties (Br, Hcj, (BH)max), with the results also shown in Table 1. The compositions of the magnets are shown in Table 2. The magnets M4 to M8 of the invention marked a coercive force increase of at least 400 kAm$^{-1}$ relative to the coercive force of the magnets P4 to P8 having undergone heat treatment without the dysprosium package while showing a remanence decline of 0 to 5 mT. The distributions of Dy and F in the magnets M4 to M8 as analyzed by EPMA were equivalent to the distributions of Tb and F in Example 1.

These data prove that magnet bodies characterized by the enrichment of Tb and/or Dy at grain boundaries, the dispersion of oxyfluoride, and the graded concentrations of Tb and/or Dy and F exhibit better magnetic properties with a minimal amount of Tb and/or Dy added.

TABLE 1

| | | Br (T) | Hcj (kA/m) | (BH)max (kJ/m$^3$) |
|---|---|---|---|---|
| Example 1 | M1 | 1.415 | 1,800 | 390 |
| Example 2 | M2 | 1.410 | 1,560 | 385 |
| Example 3 | M3 | 1.410 | 1,770 | 385 |
| Example 4 | M4 | 1.405 | 1,500 | 380 |
| Example 5 | M5 | 1.400 | 1,520 | 375 |
| Example 6 | M6 | 1.395 | 1,450 | 370 |
| Example 7 | M7 | 1.410 | 1,500 | 385 |
| Example 8 | M8 | 1.400 | 1,570 | 375 |
| Comparative Example 1 | P1 | 1.420 | 1,000 | 395 |
| Comparative Example 2 | P2 | 1.415 | 1,040 | 390 |
| Comparative Example 3 | P3 | 1.415 | 1,020 | 390 |
| Comparative Example 4 | P4 | 1.410 | 1,010 | 385 |
| Comparative Example 5 | P5 | 1.400 | 1,050 | 380 |
| Comparative Example 6 | P6 | 1.400 | 1,000 | 380 |
| Comparative Example 7 | P7 | 1.410 | 1,080 | 385 |
| Comparative Example 8 | P8 | 1.400 | 1,010 | 380 |

TABLE 2

| | | Pr [at. %] | Nd [at. %] | Tb [at. %] | Dy [at. %] | Fe + Co [at. %] | B [at. %] | F [at. %] | O [at. %] | M* [at. %] |
|---|---|---|---|---|---|---|---|---|---|---|
| Example 1 | M1 | 1.946 | 11.189 | 0.162 | 0.000 | 78.901 | 5.729 | 0.475 | 0.807 | 0.790 |
| Example 2 | M2 | 0.000 | 13.800 | 0.988 | 0.153 | 77.479 | 5.763 | 0.452 | 0.622 | 0.743 |
| Example 3 | M3 | 0.000 | 12.239 | 0.124 | 1.488 | 79.197 | 5.766 | 0.362 | 0.327 | 0.497 |
| Example 4 | M4 | 1.951 | 11.218 | 0.000 | 0.080 | 78.595 | 5.744 | 0.238 | 0.887 | 1.287 |
| Example 5 | M5 | 1.953 | 11.227 | 0.000 | 0.101 | 78.658 | 5.749 | 0.297 | 0.727 | 1.288 |
| Example 6 | M6 | 1.949 | 11.209 | 0.000 | 0.081 | 78.527 | 5.739 | 0.238 | 0.970 | 1.286 |
| Example 7 | M7 | 1.951 | 11.218 | 0.000 | 0.141 | 78.594 | 5.744 | 0.417 | 0.647 | 1.287 |
| Example 8 | M8 | 1.951 | 11.220 | 0.000 | 0.114 | 78.611 | 5.745 | 0.336 | 0.734 | 1.288 |
| Comparative Example 1 | P1 | 1.958 | 11.259 | 0.000 | 0.000 | 79.412 | 5.765 | 0.000 | 0.810 | 0.795 |
| Comparative Example 2 | P2 | 0.000 | 13.883 | 0.994 | 0.000 | 77.956 | 5.797 | 0.000 | 0.623 | 0.747 |
| Comparative Example 3 | P3 | 0.000 | 12.298 | 0.000 | 1.495 | 79.586 | 5.793 | 0.000 | 0.328 | 0.499 |
| Comparative Example 4 | P4 | 1.957 | 11.253 | 0.000 | 0.000 | 78.847 | 5.762 | 0.000 | 0.890 | 1.291 |
| Comparative Example 5 | P5 | 1.960 | 11.271 | 0.000 | 0.000 | 78.977 | 5.771 | 0.000 | 0.727 | 1.294 |
| Comparative Example 6 | P6 | 1.955 | 11.244 | 0.000 | 0.000 | 78.783 | 5.757 | 0.000 | 0.970 | 1.290 |
| Comparative Example 7 | P7 | 1.962 | 11.280 | 0.000 | 0.000 | 79.041 | 5.776 | 0.000 | 0.646 | 1.295 |
| Comparative Example 8 | P8 | 1.960 | 11.270 | 0.000 | 0.000 | 78.966 | 5.770 | 0.000 | 0.740 | 1.293 |

*Total amount of element as M in formula (1).

Analytical values of rare earth elements were determined by entirely dissolving samples (prepared as in Examples and Comparative Examples) in aqua regia, and effecting measurement by inductively coupled plasma (ICP), analytical values of oxygen determined by inert gas fusion/infrared absorption spectroscopy, and analytical values of fluorine determined by steam distillation/Alfusone colorimetry.

Japanese Patent Application No. 2005-084087 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A rare earth permanent magnet in the form of a sintered magnet body having an alloy composition $R^1{}_aR^2{}_bT_cA_dF_eO_fM_g$ wherein $R^1$ is at least one element selected from rare earth elements inclusive of Sc and Y and exclusive of Tb and Dy, $R^2$ one or both of Tb and Dy, T is one or both of iron and cobalt, A is one or both of boron and carbon, F is fluorine, O is oxygen, and M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, a through g indicative of atom percents of the corresponding elements in the alloy have values in the range: $10 \leqq a+b \leqq 15$, $3 \leqq d \leqq 15$, $0.01 \leqq e \leqq 4$, $0.04 \leqq f \leqq 4$, $0.01 \leqq g \leqq 11$, the balance being c, said magnet body having a center and a surface, wherein constituent elements F and $R^2$ are distributed such that their concentration increases on the average from the center toward the surface of the magnet body, grain boundaries surround primary phase grains of $(R^1,R^2)_2T_{14}A$ tetragonal system within the sintered magnet body, the concentration of $R^2/(R^1+R^2)$ contained in the grain boundaries is on the average higher than the concentration of $R^2/(R^1+R^2)$ contained in the primary phase grains, and an oxyfluoride of $(R^1,R^2)$ is present at grain boundaries in a grain boundary region that extends from the magnet body surface to a depth of at least 20 μm.

2. The rare earth permanent magnet of claim 1 wherein the oxyfluoride of $(R^1,R^2)$ at grain boundaries contains Nd and/or Pr, and an atomic ratio of Nd and/or Pr to $(R^1+R^2)$ contained in the oxyfluoride at grain boundaries is higher than an atomic ratio of Nd and/or Pr to $(R^1+R^2)$ contained at grain boundaries excluding the oxyfluoride and the oxide of $R^3$ wherein $R^3$ is at least one element selected from rare earth elements inclusive of Sc and Y.

3. The rare earth permanent magnet of claim 1 wherein $R^1$ comprises at least 10 atom % of Nd and/or Pr.

4. The rare earth permanent magnet of claim 1 wherein T comprises at least 60 atom % of iron.

5. The rare earth permanent magnet of claim 1 wherein A comprises at least 80 atom % of boron.

* * * * *